US006313086B1

(12) United States Patent
Askew et al.

(10) Patent No.: US 6,313,086 B1
(45) Date of Patent: Nov. 6, 2001

(54) DETERGENT COMPOSITIONS CONTAINING AND EFFERVESCENT

(75) Inventors: Stuart Clive Askew, West Jesmond; Graham Alexander Sorrie, Morpeth, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/230,879

(22) PCT Filed: Jul. 23, 1997

(86) PCT No.: PCT/US97/12900

§ 371 Date: Feb. 26, 1999

§ 102(e) Date: Feb. 26, 1999

(87) PCT Pub. No.: WO98/04661

PCT Pub. Date: Feb. 5, 1998

(30) Foreign Application Priority Data

Jul. 31, 1996 (GB) ..... 9616076
Mar. 20, 1997 (GB) ..... 9705780

(51) Int. Cl.[7] ..... C11D 3/10; C11D 3/20; C11D 3/34; C11D 3/60

(52) U.S. Cl. ..... 510/478; 510/117; 510/276; 510/445; 510/477; 510/509; 510/345; 510/444; 510/446

(58) Field of Search ..... 510/117, 276, 510/445, 477, 478, 509, 345, 444, 446

(56) References Cited

U.S. PATENT DOCUMENTS

| | | | | |
|---|---|---|---|---|
| 2,498,343 | * | 2/1950 | Rider et al. | 510/117 |
| 2,498,344 | * | 2/1950 | Rider et al. | 510/117 |
| 4,115,293 | * | 9/1978 | Schoenholz et al. | 510/117 |
| 4,181,621 | * | 1/1980 | Raaf et al. | 510/117 |
| 4,252,664 | | 2/1981 | Inamorato | 252/99 |
| 4,422,950 | | 12/1983 | Kemper et al. | 252/186.38 |
| 4,552,679 | * | 11/1985 | Schobel et al. | 510/117 |
| 4,933,100 | | 6/1990 | Ramachandran | 252/95 |
| 4,935,158 | * | 6/1990 | Aszman et al. | 510/477 |
| 5,015,408 | * | 5/1991 | Reuss | 510/117 |
| 5,225,100 | | 7/1993 | Fry et al. | 252/174.25 |
| 5,360,567 | | 11/1994 | Fry et al. | 252/90 |
| 5,407,594 | | 4/1995 | Fry et al. | 252/90 |
| 5,476,607 | * | 12/1995 | Eoga et al. | 252/99 |
| 5,578,562 | * | 11/1996 | Lockhart | 510/446 |
| 5,624,465 | * | 4/1997 | Harris | 8/137 |
| 5,658,874 | * | 8/1997 | Davies et al. | 510/446 |
| 5,679,630 | * | 10/1997 | Baeck et al. | 510/305 |
| 5,759,523 | * | 6/1998 | Hughes et al. | 424/53 |
| 5,958,334 | * | 9/1999 | Haddon | 422/5 |
| 6,024,891 | * | 2/2000 | Hughes | 252/186.31 |

* cited by examiner

*Primary Examiner*—Yogendra N. Gupta
*Assistant Examiner*—Brian P. Mruk
(74) *Attorney, Agent, or Firm*—Marianne Dressman; Kim William Zerby; Steven W. Miller

(57) ABSTRACT

Low density detergent compositions, containing sulfate and an acidic dispersing aid combined with an alkaline source, which are capable of reacting together to produce a gas, are suitable for use in laundry washing methods.

12 Claims, No Drawings

DETERGENT COMPOSITIONS CONTAINING AND EFFERVESCENT

TECHNICAL FIELD

The present invention relates to preferably a low density detergent composition containing sulphate, an acid dispersing aid and an alkali source, which is suitable for use in laundry washing methods.

BACKGROUND OF THE INVENTION

Detergent compositions, especially low density detergent compositions often contain high levels of sulphates. A problem encountered with these detergents can be the poor solubility properties of one or more components in the detergent. A consequence of this in a typical washing process can be poor dispensing of the product, either from the dispensing drawer of a washing machine, or from a dosing device placed with the laundry inside the machine. This can reduces the effectiveness of the powder. This is a particular problem at low water pressures and/or at lower washing temperatures.

The prior art teaches various ways to improve the solubility of high bulk density detergent compositions. WO95/14767 relates to the poor dispensing of high density, non-spray-dried detergent powders, and discloses the use of a citric acid salt which has a Rosin Rammler particle size of less than 800 microns. WO94/28098 discloses a non-spray-dried detergent powder comprising a combination of an ethoxylated primary C8-18 alcohol, an alkali metal aluminosilicate builder and 5 to 40wt % of a water-soluble salt of a citric acid.

The use of effervescence to improve the dispersability of granular materials has been used extensively in pharmaceutical preparations. The most widely used effervescent system in this respect is citric acid in combination with bicarbonate. This effervescent system has also been described for improving the dispersabality of pesticidal compositions for controlling water-bore pests, e.g. GB-A-2,184,946.

It has now been found that particularly in low density detergent compositions, comprising high levels of sulphate, poor dispersing can lead to insolubility/precipitation of certain components (present in the washing water) onto the fabrics in the wash and onto the washing machine. In particular, it has been found that calcium and magnesium carbonate and limesoaps, formed by the water hardness, can precipitate onto the fabric. It has been found that this can even occur when builders (which are traditionally employed in detergents to counter the adverse effect on detergency of water hardness ions) are present.

Without wishing to be bound by theory, the Applicants believe that this is due to increased ionic strength, due to the high level of sulphates present in the washing water. The Applicants have now found that this problem can be solved by the use of a specific dispersing aid. It has been found that the precipitation of various components, such as magnesium and calcium carbonates and lime soaps, can be reduced in a low density detergent composition containing sulphate, an alkali source and incorporating a dispersing aid which is an acid source, can react with the alkali source to produce a gas, and which can also act as a water-soluble dispersant or builder material.

It is believed that the reaction of the acid source and the alkali source which produces gas (preferably carbon dioxide) firstly helps the dispersion and dispensing of the detergent, reducing deposition of (detergent) components on fabrics and the machine. In addition, builder materials will be dispensed more effectively so that calcium and magnesium ions are rapidly contacted with builder material, thereby quickly and effectively reducing the free calcium and magnesium in the water so that the formation of undesirably precipitates is substantially reduced. Furthermore, once in the wash water acid is de-protonated and the base form of the acid can act as a dispersant or builder, further reducing the free calcium and magnesium in the water and further reducing the formation of undesirable precipitates.

All documents cited in the present description are incorporated herein by reference.

SUMMARY OF THE INVENTION

The present invention relates to detergent compositions comprising sulphate, an acid dispersing aid and an alkali source wherein said acid dispersing aid and said alkali source are capable of reacting together in the presence of water to produce a gas. The ratio of sulphate to acid dispersing aid is 13.5:1 or less, or the level of acid dispersing aid is at least 1.5% by weight of the detergent composition. Preferably the detergent composition is a low density detergent composition.

DETAILED DESCRIPTION OF THE INVENTION

According to a first aspect of the invention there is provided a detergent composition comprising at least 15% by weight of a sulphate salt, an acid dispersing aid and an alkali source wherein said acid dispersing aid and alkali source are capable of reacting together in the presence of water to produce a gas, and wherein the weight ratio of sulphate salt to said acid dispersing aid is from 13.5:1 or less.

According to a second aspect of the invention there is provided a detergent composition comprising at least 15% by weight of a sulphate salt, an acid dispersing aid and an alkali source wherein said acid dispersing aid and alkali source are capable of reacting together in the presence of water to produce a gas, and wherein the level of acid dispersing aid is at least 1.5% by weight of the detergent composition.

Preferably the gas produced is carbon dioxide, and therefore the alkali source is preferably bicarbonate or carbonate.

In accordance with the invention the acid dispersing aid, which is capable of reacting with the alkali source to produce a gas, is preferably capable of building and/or dispersing free ions such as calcium and magnesium ions, present in the wash.

The granular detergent compositions in accordance with the present invention generally have a bulk density of at least 500 g/liter, preferably less than 850 g/liter more preferably from 600 g/liter to 750 g/liter.

Sulphate Salt

In the present invention the ratio of sulphate salt to the acidic dispersing aid is preferably from 12:1 to 1:1, most preferably from 11:1 to 2:1.

The sulphate salt can be present in the detergent composition in any form, preferably it is an inorganic sulphate salt, such as sodium sulphate, magnesium sulphate, ammonium sulphate or mixtures of various forms of sulphate. The sulphate preferably is substantially anhydrous, (i.e. generally no greater than 50% by weight of the sulphate salt containing water, preferably no greater than 25%, more preferably no greater than 15%, most preferably no greater than 10%), preferably it is anhydrous sodium sulphate. This is preferably combined with a small amount of magnesium sulphate, preferably of from 0.2% to 5% by weight of the composition.

Acid Dispersing Aid

The acid dispersing aid is a component capable of reacting with the source of alkali in the presence of water to produce a gas.

In the first aspect of the present invention the ratio of sulphate salt to the acid dispersing aid is 13.5:1 or less, more preferably from 12:1 to 1:1, most preferably from 11:1 to 2:1. The acid dispersing aid is preferably present at a level of from 0.05% to 25%, more preferably at a level of 0.5% to 15%, even more preferably of from 1% to 10%, even more preferably from 1% to 7%, most preferably of from 2% to 5% by weight of the detergent composition.

In the second aspect of the invention the level of the acid dispersing aid is at least 1.5% or more, preferably from 2% to 7% by weight of the composition.

Preferably, the detergent composition comprises at least 1.5% by weight of acid dispersing aid and 20.25% by weight of sulphate salts, in a ratio of sulphate salt to acid dispersing aid is from 13.5:1 or less.

In accordance with the invention the acid dispersing aid, which is capable of reacting with the alkali source to produce a gas, is preferably capable of building and/or dispersing free ions such as calcium and magnesium ions, present in the wash.

Preferably, 80% or more of the acid dispersing aid has a particle size in the range of from about 150 microns to about 710 microns, with at least about 37% by weight of the acid source having a particle size of about 350 microns or less. More preferably 100% of the acid compound has a particle size of about 710 microns or less. Further preferred acid dispersing aids are such that more than about 38%, more preferably 38.7%, of the acidic compound has a particle size of about 350 microns or less.

The particle size of the acidic compound is calculated by sieving a sample of the source of acidity on a series of Tyler sieves. For example, a Tyler sieve mesh 100 corresponds to an aperture size of 150 microns. The weight fractions thereby obtained are plotted against the aperture size of the sieves.

The acid dispersing aid may be any suitable organic, mineral or inorganic acid, or a derivative thereof, or a mixture thereof. The acidic compound may be a mono-, bi- or tri-protonic acid. Preferably, the compound is a tri-protonic acid. Preferred derivatives include a salt or ester of the acid. The acid compound is preferably non-hygroscopic, which can improve storage stability. Organic acids and optionally their derivatives are preferred. The acid is preferably water-soluble. Most preferably the acid dispersing aid is selected such that its base form, formed in solution or after reaction with a alkaline source, can built and/or disperse free ions, such as calcium and magnesium ions, present in the wash.

Suitable acids include citric, glutaric, tartaric succinic or adipic acid, monosodium phosphate, boric acid, or a salt or an ester thereof. Citric acid is especially preferred.

Alkali Source

In accordance with the present invention, an alkali source is present such that it has the capacity to react with the source of acid dispersing aid to produce a gas. Preferably this gas is carbon dioxide, and therefore the alkali is a carbonate, or suitable derivative thereof.

The detergent composition of the present invention preferably contains from about 2% to about 75%, preferably from about 5% to about 60%, most preferably from about 10% to about 30% by weight of the alkali source. When the alkali source is present in an agglomerated detergent particle, the agglomerate preferably contains from about 10% to about 60% of the alkali source.

In accordance with the invention the acid dispersing aid, which is capable of reacting with the alkali source to produce a gas, is preferably capable of building and/or dispersing free ions such as calcium and magnesium ions, present in the wash.

In a preferred embodiment, the alkali source is a carbonate. Examples of preferred carbonates are the alkaline earth and alkali metal carbonates, including sodium carbonate, bicarbonate and sesqui-carbonate and any mixtures thereof with ultra-fine calcium carbonate such as are disclosed in German Patent Application No. 2,321,001 published on Nov. 15, 1973. Alkali metal percarbonate salts are also suitable sources of carbonate species and are described in more detail in the section 'inorganic perhydrate salts' herein.

The carbonate and bicarbonate preferably have a amorphous structure. Preferably the carbonate and bicarbonates are coated with coating materials. The particles of carbonate and bicarbonate can have a mean particle size of 250 $\mu$m or greater, preferably 500 $\mu$m or greater. It is preferred that fewer than 20% of the particles have a particle size below 500 $\mu$m.

The mean particle size of the particles of carbonate and bicarbonate herein is determined by reference to a method involving choice of varied sizes of sieve through which the sample is attempted to be passed. The mean particle size of a sample is given by the diameter of sieve through which half of the mass of the sample will pass, and accordingly through which half of the sample will not pass.

The alkalinity system may include other components, such as is a silicate. Suitable silicates include the water soluble sodium silicates with an $SiO_2$: $Na_2O$ ratio of from 1.0 to 2.8, with ratios of from 1.6 to 2.0 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate. Alkali metal persilicates are also suitable sources of silicate herein.

Suitable silicates include the sodium silicates with an $SiO_2$:$Na_2O$ ratio of from 1.0 to 2.8, with ratios of from 1.6 to 2.0 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate. Preferably the silicates have an amorphous structure.

Other suitable sources will be known to those skilled in the art.

Additional Detergent Components

The detergent compositions of the invention may also contain additional detergent components. The precise nature of these additional components, and levels of incorporation thereof will depend on the physical form of the composition, and the precise nature of the washing operation for which it is to be used.

The compositions of the invention preferably contain one or more additional detergent components selected from surfactants, bleaches, builders, organic polymeric compounds, enzymes, suds suppressors, lime soap dispersants, soil suspension and anti-redeposition agents and corrosion inhibitors.

Surfactant

The detergent compositions of the invention preferably contains one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitterionic surfactants are generally used in combination with one or more anionic and/or nonionic surfactants.

Anionic Surfactant

A preferred additional component of the detergent composition of the invention is an anionic surfactant. Any anionic surfactants useful for detersive purposes are suitable. Examples include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

The weight ratio of anionic surfactant to cationic ester surfactant in the surfactant system is from 3:1 to 15:1, preferably from 4:1 to 12:1, most preferably from 5:1 to 10:1.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_9$–$C_{22}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxyiated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$–$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—$CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

A preferred additional surfactant in accord with the detergent composition of the invention is a nonionic surfactant present at a level of from 0.1% to 20%, more preferably from 0.2% to 10% by weight, most preferably from 0.5% to 5% by weight of the detergent composition.

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

A preferred nonionic polyhydroxy fatty acid amide surfactant for use herein is a $C_{15}$–$C_{17}$ alkyl N-methyl glucamide. The ratio of polyhydroxy fatty acid amide to cationic ester surfactant is preferably between 1:1 to 1:8, more preferably 1:2.5. It has been found that such surfactant systems are able to reduce 'lime soap' formation and deposition of encrustation on the fabric.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonia hexanoate and the $C_{10-18}$ acylamidopropane (or ethane) dimethyl (or diethyl) betaines. Complex betaine surfactants are also suitable for use herein.

Cationic Surfactants

Cationic surfactants can also be used in the detergent compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Another group of suitable cationic surfactants herein are esters of quaternary ammonium alcohols, such as quaternary choline esters.

Water-soluble Builder Compound

The detergent compositions of the present invention preferably contain a water-soluble builder compound, typically present at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The detergent compositions of the present invention may contain a partially soluble or insoluble builder compound, typically present at a level of from 10% to 80% by weight, preferably from 10% to 70% by weight, most preferably from 20% to 60% weight of the composition.

Examples of largely water insoluble builders include the sodium aluminosilicates.

Suitable aluminosilicate zeolites have the unit cell formula $Naz_z[(AlO_2)_z(SiO_2)y]$. $xH_2O$. wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276\ H_2O$.

Another preferred builder material is a crystalline layered silicate, preferably a crystalline δ-layered silicate, and most preferably the crystalline δ-layered silicate is a crystalline δ-layered sodium silicate with the general formula $$NaMSi_xO_{2+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. Herein, x in the general formula above preferably has a value of 2, 3 or 4 and is preferably 2. The most preferred material is δ-$Na_2Si_2O_5$, available from Hoechst AG as NaSKS-6.

The crystalline layered silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Organic Peroxyacid Bleaching System

A preferred feature of detergent compositions of the invention is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

Inorganic perhydrate salts are a preferred source of hydrogen peroxide. These salts are normally incorporated in the form of the alkali metal, preferably sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material, such as described in the section 'delayed release-means '. Coatings can also be used to provide better storage stability for the perhydrate salt in the granular product. Suitable coatings therefor comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

In a preferred aspect of the present invention a means is provided to delay the release to a wash solution of the preferred inorganic perhydrate salts, relatively to the release of the cationic ester surfactant. Said means can comprise equivalents of any of the delayed release means herein described for achieving the delayed release of the alkalinity system or species, described hereinbefore.

Peroxyacid Bleach Precursors

Peroxyacid bleach precursors (bleach activators) are preferred peroxyacid sources in accord with the invention. Peroxyacid bleach precursors are normally incorporated at a level of from 0.5% to 20% by weight, more preferably from 2% to 10% by weight, most preferably from 3% to 5% by weight of the compositions.

Suitable peroxyacid bleach precursors typically contain one or more N- or O-acyl groups, which precursors can be selected from a wide range of classes. Suitable classes include anhydrides, esters, imides and acylated derivatives of imidazoles and oximes, and examples of useful materials within these classes are disclosed in GB-A-1586789.

Suitable esters are disclosed in GB-A-836988, 864798, 1147871, 2143231 and EP-A-0170386. The acylation products of sorbitol, glucose and all saccharides with benzoylating agents and acetylating agents are also suitable.

Specific O-acylated precursor compounds include 2,3,3-tri-methyl hexanoyl oxybenzene sulfonates, benzoyl oxybenzene sulfonates, nonanoyl-6-amino caproyl oxybenzene sulfonates, monobenzoyltetraacetyl glucose benzoyl peroxide and cationic derivatives of any of the above, including the alkyl ammonium derivatives and pentaacetyl glucose. Phthalic anhydride is a suitable anhydride type precursor.

Specific cationic derivatives of the O-acyl precursor compounds include 2-(N,N,N-trimethyl ammonium)ethyl sodium 4-sulphophenyl carbonate chloride, and any of the alkyl ammonium derivatives of the benzoyl oxybenzene sulfonates including the 4-(trimethyl ammonium)methyl derivative.

Useful N-acyl compounds are disclosed in GB-A-855735, 907356 and GB-A-1246338.

Preferred precursor compounds of the imide type include N-benzoyl succinimide, tetrabenzoyl ethylene diamine, N-benzoyl substituted ureas and the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. Preferably, the tetraacetyl ethylene diamine has a compressed particle structure, achieved by mechanically compression, to delay the desolving of the particles into the wash solution.

N-acylated precursor compounds of the lactam class are disclosed generally in GB-A-955735. Preferred materials comprise the caprolactams and valerolactams.

Suitable N-acylated lactam precursors have the formula:

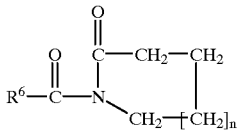

wherein n is from 0 to 8, preferably from 0 to 2, and $R^6$ is H, an alkyl, aryl, alkoxyaryl or alkaryl group containing from 1 to 12 carbons, or a substituted phenyl group containing from 6 to 18 carbon atoms.

Suitable caprolactam bleach precursors are of the formula:

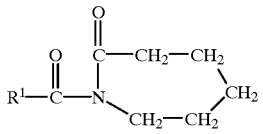

wherein $R^1$ is H or an alkyl, aryl, alkoxyaryl or alkaryl group containing from 1 to 12 carbon atoms, preferably from 6 to 12 carbon atoms, most preferably $R^1$ is phenyl.

Suitable valero lactams have the formula:

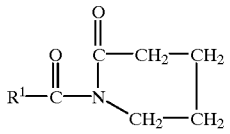

wherein $R^1$ is H or an alkyl, aryl, alkoxyaryl or alkaryl group containing from 1 to 12 carbon atoms, preferably from 6 to 12 carbon atoms. In highly preferred embodiments, $R^1$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino alkyl, alkyl, aryl and alkoxy derivatives.

Caprolactam and valerolactam precursor materials wherein the $R^1$ moiety contains at least 6, preferably from 6 to 12, carbon atoms provide peroxyacids on perhydrolysis of a hydrophobic character which afford nucleophilic and body soil clean-up. Precursor compounds wherein $R^1$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1:1, can be used herein for mixed stain removal benefits.

Highly preferred caprolactam and valerolactam precursors include benzoyl caprolactam, nonanoyl capro-lactam, benzoyl valerolactam, nonanoyl valerolactam, 3,5,5-trimethylhexanoyl caprolactam, 3,5,5-trimethylhexanoyl valerolactam, octanoyl caprolactam, octanoyl valerolactam, decanoyl caprolactam, decanoyl valerolactarn, undecenoyl caprolactam, undecenoyl valerolactam, (6-octanamidocaproyl)oxybenzene-sulfonate, (6-nonanamidocaproyl)oxybenzenesulfonate, (6-decanamidocaproyl)-oxybenzenesulfonate, and mixtures thereof. Examples of highly preferred substituted benzoyl lactams include methylbenzoyl caprolactam, methylbenzoyl valerolactam, ethylbenzoyl caprolactam, ethylbenzoyl valerolactam, propylbenzoyl caprolactam, propylbenzoyl valerolactam, isopropylbenzoyl caprolactam, isopropylbenzoyl valerolactam, butylbenzoyl caprolactam, butylbenzoyl valerolactam, tert-butylbenzoyl caprolactam, tert-butylbenzoyl valerolactam, pentylbenzoyl caprolactam, pentylbenzoyl valerolactam, hexylbenzoyl caprolactam, hexylbenzoyl valerolactam, ethoxybenzoyl caprolactam, ethoxybenzoyl valerolactam, propoxybenzoyl caprolactam, propoxybenzoyl valerolactam, isopropoxybenzoyl caprolactam, isopropoxybenzoyl valerolactam, butoxybenzoyl caprolactam, butoxybenzoyl valerolactam, tert-butoxybenzoyl caprolactam, tert-butoxybenzoyl valerolactam, pentoxybenzoyl caprolactam, pentoxybenzoyl valerolactam, hexoxybenzoyl caprolactam, hexoxybenzoyl valerolactam, 2,4,6-trichlorobenzoyl caprolactam, 2,4,6-trichlorobenzoyl valerolactam, pentafluorobenzoyl caprolactam, pentafluorobenzoyl valerolactam, dichlorobenzoyl caprolactam, dimethoxybenzoyl caprolactam, 4-chlorobenzoyl caprolactam, 2,4-dichlororbenzoyl caprolactam, terephthaloyl dicaprolactam, pentafluorobenzoyl caprolactam, pentafluorobenzoyl valerolactam, dichlorobenzoyl valerolactarn, dimethoxybenzoyl valerolactamn, 4-chlorobenzoyl valerolactam, 2,4-dichlororbenzoyl valerolactam, terephthaloyl divalerolactam, 4-nitrobenzoyl caprolactam, 4-nitrobenzoyl valerolactam, and mixtures thereof.

Suitable imidazoles include N-benzoyl imidazole and N-benzoyl benzimidazole and other useful N-acyl group-containing peroxyacid precursors include N-benzoyl pyrrolidone, dibenzoyl taurine and benzoyl pyroglutamic acid.

Another preferred class of peroxyacid bleach activator compounds are the amide substituted compounds of the following general formulae:

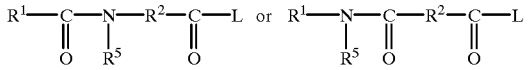

wherein $R^1$ is an aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

The L group must be sufficiently reactive for the reaction to occur within the optimum time frame (e.g., a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behavior are those in which their conjugate acid has a pKa in the range of from 4 to 13, preferably from 6 to 11 and most preferably from 8 to 11.

Preferred bleach precursors are those wherein $R^1$, $R^2$ and $R^5$ are as defined for the amide substituted compounds and L is selected from the group consisting of:

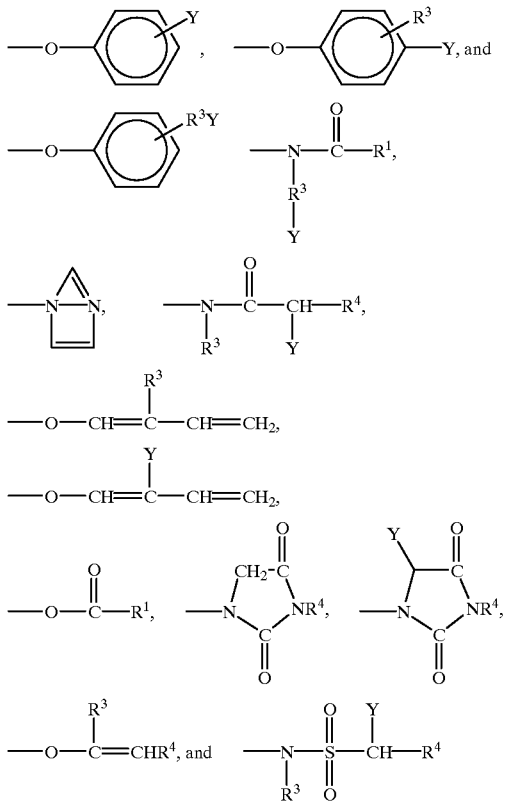

and mixture thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred examples of bleach activators of the above formulae include (6-octanamidocaproyl) oxybenzenesulfonate, (6-nonanamidocaproyl) oxybenzenesulfonate, (6-decanamidocaproyl) oxybenzenesulfonate, and mixtures thereof.

Other preferred precursor compounds include those of the benzoxazin-type, having the formula:

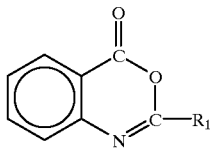

including the substituted benzoxazins of the type

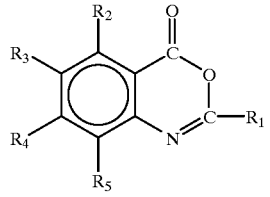

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

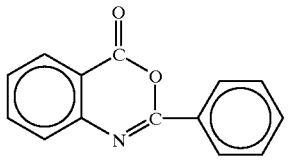

Bleach Catalyst

The detergent compositions optionally contain a transition metal containing bleach catalyst. One suitable type of bleach catalyst is a catalyst system comprising a heavy metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and 5,244,594. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. Nos. 4,246,612 and 5,227,084. See also U.S. Pat. No. 5,194,416 which teaches mononuclear manganese (IV) complexes such as Mn(1,4,7-trimethyl-1,4,7-triazacyclononane)$(OCH_3)_3$—$(PF_6)$. Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

Further suitable bleach catalysts are described, for example, in European patent application No. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Heavy Metal Ion Sequestrant

The detergent compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta(methylene phosphonate), ethylene diamine tri (methylene phosphonate)hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Enzyme

Another preferred ingredient useful in the detergent compositions is one or more additional enzymes.

Preferred additional enzymatic materials include the commercially available lipases, cutinases, amylases, neutral and alkaline proteases, esterases, cellulases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Preferably the detergent composition in accordance with the present invention contains a lipolytic enzyme. It has been found that the cationic ester surfactant enhances the performance of the lipolytic enzyme. Two mechanisms are believed to be responsible for the improved enzyme performance. Firstly, the fatty acids, which are formed by the enzymatic reaction of the lipolytic enzymes with triglycerides contained in the greasy or oily soils, will be removed from the fabric surface by the cationic ester surfactant. This will facilitate the 'access' by the enzymes to the greasy stains/soils during the washing process. Secondly, the removal of fatty acids from the fabric surface by the cationic ester surfactant will reduce the formation and deposition onto the fabric of 'lime soap', formed through reaction of fatty acids with calcium ions of the hardness of the water. This will also facilitate the 'access' by the enzymes to the greasy stains/soils on the fabric surface.

Lipolytic enzyme may be present at levels of active lipolytic enzyme of from 0.01% to 5% by weight, preferably 0.1% to 2% by weight, most preferably from 0.1% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes,* which is described in Granted European Patent, EP-B-0218272.

Another preferred lipase herein is obtained by cloning the gene from *Humicola lanuginosa* and expressing the gene in *Aspergillus oryza,* as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989. A highly preferred lipase, which is also obtained via *Humicola lanuginosa,* is a lipase known as Lipase Ultra SP514 (trade name), also available from NOVO Industri A/S.

Organic Polymeric Compound

Organic polymeric compounds are preferred additional components of the detergent compositions in accord with the invention, and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Another organic compound, which is a preferred clay dispersant/anti-redeposition agent, for use herein, can be the ethoxylated cationic monoamines and diamines of the formula:

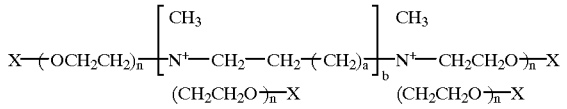

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. Nos. 4,659,802 and 4,664,848.

Suds Supressing System

The detergent compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts. A disadvantage associated with such fatty acid antifoams is their tendency to interact with any $Ca^{++}$ or $Mg^{++}$ ion present in the wash solution, to form insoluble 'lime soaps', which can deposit on the fabric in the wash. It has now been found that this problem can be reduced by the presence of cationic ester surfactants. The cationic ester surfactant interacts with the formed 'lime soaps', thereby suspending them in the wash solution, and thus reducing the deposition of the formed 'lime soaps' on the fabric in the wash.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises (a) antifoam compound, preferably silicone antifoam compound, most preferably a silicone antifoam compound comprising in combination (i) polydimethyl siloxane, at a level of from 50% to 99%, preferably 75% to 95% by weight of the silicone antifoam compound; and (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Clay Softening System

The detergent compositions may contain a clay softening system comprising a clay mineral compound and optionally a clay flocculating agent.

The clay mineral compound is preferably a smectite clay compound. Smectite clays are disclosed in the U.S. Pat. Nos. 3,862,058, 3,948,790, 3,954,632 and 4,062,647. European Patents Nos. EP-A-299,575 and EP-A-313,146 in the name of the Procter and Gamble Company describe suitable organic polymeric clay flocculating agents.

Polymeric Dye Transfer Inhibiting Agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

a) Polyamine N-oxide Polymers

Polyamine N-oxide polymers suitable for use herein contain units having the following structure formula:

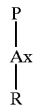

(I)

wherein P is a polymerisable unit, and

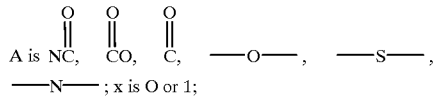

A is NC(=O), CO(=O), C(=O), —O—, —S—, —N— ; x is O or 1;

R are aliphatic, ethoxylated aliphatics, aromatic heterocyclic or alicyclic groups or any combination thereof whereto the nitrogen of the N—O group can be attached or wherein the nitrogen of the N—O group is part of these groups.

The N—O group can be represented by the following general structures:

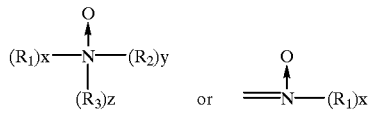

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups. The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Other suitable polyamine N-oxides are the polyamine oxides whereto the N—O group is attached to the polymerisable unit. A preferred class of these polyamine N-oxides comprises the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof.

The polyamine N-oxides can be obtained in almost any degree of polymerisation. The degree of polymerisation is not critical provided the material has the desired water-solubility and dye-suspending power. Typically, the average molecular weight is within the range of 500 to 1000,000.

b) Copolymers of N-vinylpyrrolidone and N-vinylimidazole

Suitable herein are coploymers of N-vinylimidazole and N-vinylpyrrolidone having an average molecular weight range of from 5,000 to 50,000. The preferred copolymers have a molar ratio of N-vinylimidazole to N-vinylpyrrolidone from 1 to 0.2.

c) Polyvinylpyrrolidone

The detergent compositions herein may also utilize polyvinylpyrrolidone ("PVP") having an average molecular weight of from 2,500 to 400,000. Suitable polyvinylpyrrolidones are commercially vailable from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Cooperation include Sokalan HP 165 and Sokalan HP 12.

d) Polyvinyloxazolidone

The detergent compositions herein may also utilize polyvinyloxazolidones as polymeric dye transfer inhibiting agents. Said polyvinyloxazolidones have an average molecular weight of from 2,500 to 400,000.

e) Polyvinylimidazole

The detergent compositions herein may also utilize polyvinylimidazole as polymeric dye transfer inhibiting agent. Said polyvinylimidazoles preferably have an average molecular weight of from 2,500 to 400,000.

Optical Brightener

The detergent compositions herein also optionally contain from about 0.005% to 5% by weight of certain types of hydrophilic optical brighteners.

Hydrophilic optical brighteners useful herein include those having the structural formula:

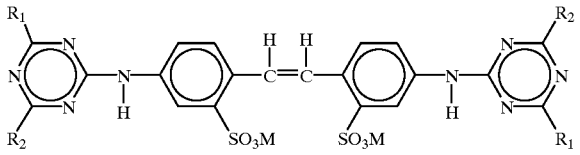

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Cationic Fabric Softening Agents

Cationic fabric softening agents can also be incorporated into compositions in accordance with the present invention. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from 0.5% to 15% by weight, normally from 1% to 5% by weight.

Other Optional Ingredients

Other optional ingredients suitable for inclusion in the compositions of the invention include perfumes, colours and filler salts, with sodium sulfate being a preferred filler salt.

pH of the Compositions

The present compositions preferably have a pH measured as a 1% solution in distilled water of at least 9.0, preferably from 9.0 to 11.5, most preferably from 9.5 to 10.5.

Form of the Compositions

The detergent composition of the invention can be made via a variety of methods, including spray-drying, dry-mixing and agglomerating of the various compounds comprised in the detergent composition. The acidic source of the invention is preferably dry-added.

The compositions in accordance with the invention can take a variety of physical forms including granular, tablet, bar and liquid forms. The compositions are particularly the so-called concentrated granular detergent compositions adapted to be added to a washing machine by means of a dispensing device placed in the machine drum with the soiled fabric load. The detergent is preferably a blown powder, whereby the sulphate components is comprised in the blown powder or is dry-added.

The mean particle size of the components of granular compositions in accordance with the invention can be from 0.1 mm to 5.0 mm, but it should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves.

The mean particle size is taken to be the aperture size through which 50% by weight of the sample would pass.

The granular detergent compositions in accordance with the present invention typically have a bulk density of at least 500 g/liter, preferably less than 850 g/liter more preferably from 600 g/liter to 750 g/liter. Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg; a knife, across its upper edge. The filled cup is then weighed and the value obtained for the weight of powder doubled to provide a bulk density in g/liter. Replicate measurements are made as required.

Surfactant Agglomerate Particles

The surfactant system herein is can be present in granular compositions in the form of surfactant agglomerate particles, which may take the form of flakes, prills, marumes, noodles, ribbons, but preferably take the form of granules. The most preferred way to process the particles is by agglomerating powders (e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7-9, Postfach 2050, Germany. Most preferably a high shear mixer is used, such as a Lodige CB (Trade Name).

Alternatively, the surfactants or part thereof is comprised in the blown powder, as mentioned above.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 40 g to 300 g of product dissolved or dispersed in a wash solution of volume from 5 to 65 liters, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle. Especially preferred dispensing devices for use with the composition of the invention have been described in the following patents; GB-B-2,157,717, GB-B-2,157,718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form. These patent applications explicitely discribe the use of such devices for high density and other detergents in general, however when low density detergents, in accord with the present invention, are used the size of the dispensing device should be adjusted to the volume of the low density detergent which is preferably used for one wash cycle.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

Packaging for the Compositions

Commercially marketed executions of the bleaching compositions can be packaged in any suitable container including those constructed from paper, cardboard, plastic materials and any suitable laminates. A preferred packaging execution is described in European Application No. 94921505.7.

Abbreviations Used in Following Examples

In the detergent compositions, the abbreviated component identifications have the following meanings:

| | |
|---|---|
| LAS | Sodium linear $C_{12}$ alkyl benzene sulfonate |
| TAS | Sodium tallow alkyl sulfate |
| C45AS | Sodium $C_{14}$–$C_{15}$ linear alkyl sulfate |
| CxyEzS | Sodium $C_{1x}$–$C_{1y}$ branched alkyl sulfate condensed with z moles of ethylene oxide |
| C45E7 | A $C_{14-15}$ predominantly linear primary alcohol condensed with an average of 7 moles of ethylene oxide |
| C25E3 | A $C_{12-15}$ branched primary alcohol condensed with an average of 3 moles of ethylene oxide |
| C25E5 | A $C_{12-15}$ branched primary alcohol condensed with an average of 5 moles of ethylene oxide |
| CEQ | $R_1COOCH_2CH_2.N^+(CH_3)_3$ with $R_1 = C_{11}$–$C_{13}$ |
| QAS | $R_2.N^+(CH_3)_2(C_2H_4OH)$ with $R_2 = C_{12}$–$C_{14}$ |

-continued

| | |
|---|---|
| Soap | Sodium linear alkyl carboxylate derived from an 80/20 mixture of tallow and coconut oils. |
| TFAA | $C_{16}$–$C_{18}$ alkyl N-methyl glucamide |
| TPKFA | $C_{12}$–$C_{14}$ topped whole cut fatty acids |
| STPP | Anhydrous sodium tripolyphosphate |
| Zeolite A | Hydrated Sodium Aluminosilicate of formula $Na_{12}(A10_2SiO_2)_{12}.27H_2O$ having a primary particle size in the range from 0.1 to 10 micrometers |
| NaSKS-6 | Crystalline layered silicate of formula $\delta$-$Na_2Si_2O_5$ |
| Citric acid | Anhydrous citric acid |
| Carbonate | Anhydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous Sodium Silicate ($SiO_2$:$Na_2O$; 2.0 ratio) |
| Sodium sulfate | Anhydrous sodium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000. |
| CMC | Sodium carboxymethyl cellulose |
| Protease | Proteolytic enzyme of activity 4 KNPU/g sold by NOVO Industries A/S under the tradename Savinase |
| Alcalase | Proteolytic enzyme of activity 3 AU/g sold by NOVO Industries A/S |
| Cellulase | Cellulytic enzyme of activity 1000 CEVU/g sold by NOVO Industries A/S under the tradename Carezyme |
| Amylase | Amylolytic enzyme of activity 60 KNU/g sold by NOVO Industries A/S under the tradename Termamyl 60T |
| Lipase | Lipolytic enzyme of activity 100 KLU/g sold by NOVO Industries A/S under the tradename Lipolase |
| Endolase | Endoglunase enzyme of activity 3000 CEVU/g sold by NOVO Industries A/S |
| PB4 | Sodium perborate tetrahydrate of nominal formula $NaBO_2.3H_2O.H_2O_2$ |
| PB1 | Anhydrous sodium perborate monohydrate bleach of nominal formula $NaBO_2.H_2O_2$ |
| Percarbonate | Sodium Percarbonate of nominal formula $2Na_2CO_3.3H_2O_2$ |
| NOBS | Nonanoyloxybenzene sulfonate in the form of the sodium salt. |
| TAED | Tetraacetylethylenediamine |
| DTPMP | Diethylene triamine penta (methylene phosphonate), marketed by Monsanto under the Trade name Dequest 2060 |
| Photoactivated | Sulfonated Zinc Phthlocyanine encapsulated in bleach dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate. |
| HEDP | 1,1-hydroxyethane diphosphonic acid |
| PVNO | Polyvinylpyridine N-oxide |
| PVPVI | Copolymer of polyvinylpyrolidone and vinylimidazole |
| SRP 1 | Sulfobenzoyl end capped esters with oxyethylene oxy and terephtaloyl backbone |
| SRP 2 | Diethoxylated poly (1, 2 propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1. |
| Alkalinity | % weight equivalent of NaOH, as obtained using the alkalinity release test method described herein. |

In the following Examples all levels are quoted as % by weight of the composition:

EXAMPLE 1

The following granular laundry detergent compositions A, B, C and D of bulk density 650 g/liter were prepared in accord with the invention:

| | A | B | C | D |
|---|---|---|---|---|
| LAS | 5.61 | 4.76 | 6.0 | 7.0 |
| TAS | 1.86 | 1.57 | 1.4 | 1.3 |
| C45AS | 2.24 | 3.89 | 2.2 | 2.2 |
| C25AE3S | 0.76 | 1.18 | 1.18 | 1.18 |
| C45E7 | — | 5.0 | — | 5.0 |
| C25E3 | 5.5 | — | 5.0 | — |
| QAS | 2.0 | 2.0 | — | — |
| STPP | — | — | — | — |
| Zeolite A | 19.5 | 19.5 | 15.5 | 15.5 |
| NaSKS-6/citric acid (79:21) | 10.6 | 10.6 | 10.6 | 8.6 |
| Carbonate | 21.4 | 21.4 | 15.4 | 17.1 |
| Bicarbonate | 2.0 | 2.0 | — | — |
| Silicate | — | — | — | — |
| Sodium sulfate | 15.0 | 17.0 | 16.5 | 18.5 |
| PB4 | 12.7 | — | — | 10.3 |
| TAED | 3.1 | — | — | 2.1 |
| DETPMP | 0.2 | 0.2 | 0.2 | 0.2 |
| HEDP | 0.3 | 0.3 | 0.3 | 0.3 |
| Protease | 0.85 | 0.85 | 0.05 | 0.85 |
| Lipase | 0.15 | 0.15 | 0.15 | 0.15 |
| Cellulase | 0.28 | 0.28 | 0.28 | 0.28 |
| Amylase | 0.1 | 0.1 | 0.1 | 0.1 |
| MA/AA | 1.6 | 1.6 | 1.6 | 1.6 |
| CMC | 0.4 | 0.4 | 0.4 | 0.4 |
| Photoactivated bleach (ppm) | 27 ppm | 27 ppm | 27 ppm | 27 ppm |
| Brightener 1 | 0.19 | 0.19 | 0.19 | 0.19 |
| Brightener 2 | 0.04 | 0.04 | 0.04 | 0.04 |
| Perfume | 0.3 | 0.3 | 0.3 | 0.3 |
| Silicone antifoam | 2.4 | 2.4 | 2.4 | 2.4 |
| Citric acid | 4.5 | 2.0 | 3.0 | 6.0 |
| Minors/misc to 100% | | | | |

EXAMPLE 2

The following detergent formulations, according to the present invention were prepared.

| | E | F | G |
|---|---|---|---|
| Blown Powder | | | |
| STPP | 14.0 | — | 14.0 |
| Zeolite A | — | 20.0 | — |
| C45AS | 9.0 | 6.0 | 8.0 |
| MA/AA | 2.0 | 4.0 | 2.0 |
| LAS | 6.0 | 8.0 | 9.0 |
| TAS | 2.0 | — | — |
| CEQ | — | 3.0 | 3.5 |
| Silicate | 7.0 | 8.0 | 8.0 |
| CMC | 1.0 | 1.0 | 0.5 |
| Brightener 2 | 0.2 | 0.2 | 0.2 |
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 26.0 | 23.0 | 25.0 |
| PB4 | 18.0 | 18.0 | 10 |
| PB1 | 4.0 | 4.0 | 0 |
| TAED | 3.0 | 3.0 | 1.0 |
| Photoactivated bleach | 0.02 | 0.02 | 0.02 |
| Protease | 1.0 | 1.0 | 1.0 |
| Lipase | 0.4 | 0.4 | 0.4 |
| Amylase | 0.25 | 0.30 | 0.15 |
| Dry mixed sodium sulfate | 15.0 | 18.0 | 22.0 |
| Citric acid | 2.5 | 2.0 | 5.0 |

-continued

| | E | F | G |
|---|---|---|---|
| Balance (Moisture & Miscellaneous) | 100.0 | 100.0 | 100.0 |
| Density (g/liter) | 630 | 670 | 670 |

EXAMPLE 3

The following nil bleach-containing detergent formulations of particular use in the washing of colored clothing, according to the present invention were prepared:

| | H | I |
|---|---|---|
| Blown Powder | | |
| Zeolite A | 15.0 | — |
| Sodium sulfate | 5.0 | — |
| LAS | 3.0 | — |
| CEQ | 0.4 | 1.3 |
| DTPMP | 0.4 | — |
| CMC | 0.4 | — |
| MA/AA | 4.0 | — |
| Agglomerates | | |
| C45A5 | — | 11.0 |
| LAS | 6.0 | — |
| TAS | 3.0 | — |
| Silicate | 4.0 | — |
| Zeolite A | 10.0 | 13.0 |
| CMC | — | 0.5 |
| MA/AA | — | 2.0 |
| Carbonate | 9.0 | 7.0 |
| Spray On | | |
| Perfume | 0.3 | 0.5 |
| C45E7 | 4.0 | 4.0 |
| C25E3 | 2.0 | 2.0 |
| Dry additives | | |
| MA/AA | — | 3.0 |
| NaSKS-6 | — | 12.0 |
| Citric acid | 4.0 | 3.0 |
| Citrate | 10.0 | 8.0 |
| Bicarbonate | 7.0 | 5.0 |
| Carbonate | 8.0 | 7.0 |
| PVPVI/PVNO | 0.5 | 0.5 |
| Alcalase | 0.5 | 0.9 |
| Lipase | 0.4 | 0.4 |
| Amylase | 0.6 | 0.6 |
| Cellulase | 0.6 | 0.6 |
| Silicone antifoam | 5.0 | 5.0 |
| Dry additives | | |
| Sodium sulfate | 10.5 | 19.5 |
| Balance (Moisture and Miscellaneous) | 100.0 | 100.0 |
| Density (g/liter) | 700 | 700 |

EXAMPLE 4

The following detergent formulations, according to the present invention were prepared:

| | J | K | L | M |
|---|---|---|---|---|
| LAS | 12.0 | 12.0 | 12.0 | 10.0 |
| QAS | 0.7 | 1.0 | — | 0.7 |
| TFAA | — | 1.0 | — | — |
| C25E5/C45E7 | — | 2.0 | — | 0.5 |

-continued

| | J | K | L | M |
|---|---|---|---|---|
| C45E3S | — | 3.0 | — | — |
| CEQ | 2.0 | — | 1.0 | — |
| STPP | 30.0 | 18.0 | 15.0 | — |
| Silicate | 9.0 | 7.0 | 10.0 | — |
| Carbonate | 15.0 | 10.5 | 15.0 | 25.0 |
| Bicarbonate | — | 4.0 | — | — |
| Sodium Sulphate | 18.0 | 16.5 | 21.5 | 20.5 |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 0.8 | 1.0 | 0.5 | 0.5 |
| Amylase | 0.8 | 0.4 | — | 0.25 |
| Lipase | 0.2 | 0.1 | 0.2 | 0.1 |
| Cellulase | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| PB1 | 6.0 | 2.0 | — | — |
| NOBS | 2.0 | 1.0 | — | — |
| Citric acid | 3.5 | 5.0 | 2.5 | 6.0 |
| Balance (Moisture and Miscellaneous) | 100 | 100 | 100 | 100 |

EXAMPLE 5

The following detergent formulations, according to the present invention were prepared:

| | N | O | P |
|---|---|---|---|
| Blown Powder | | | |
| Zeolite A | 10.0 | 15.0 | 6.0 |
| Sodium sulfate | 19.0 | 15.0 | 7.0 |
| MA/AA | 3.0 | 3.0 | 6.0 |
| LAS | 10.0 | 8.0 | 10.0 |
| C45AS | 4.0 | 5.0 | 7.0 |
| CEQ | 2.0 | — | 2.0 |
| Silicate | — | 1.0 | 7.0 |
| Soap | — | — | 2.0 |
| Brightener 1 | 0.2 | 0.2 | 0.2 |
| Carbonate | 28.0 | 18.0 | 20.0 |
| DTPMP | — | 0.4 | 0.4 |
| Spray On | | | |
| C45E7 | 1.0 | 1.0 | 1.0 |
| Dry additives | | | |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NOBS | — | 6.1 | 4.5 |
| PBI | 1.0 | 5.0 | 6.0 |
| Sodium sulfate | — | 6.0 | — |
| Citric acid | 4.5 | 1.4 | 5.0 |
| Balance (Moisture and Miscellaneous) | 100 | 100 | 100 |

EXAMPLE 6

The following bleach-containing detergent formulations, according to the present invention were prepared:

| | Q | R |
|---|---|---|
| Blown Powder | | |
| Zeolite A | 15.0 | 15.0 |
| Sodium sulfate | 0.0 | 12.0 |
| LAS | 3.0 | 3.0 |
| QAS | — | 1.5 |
| CEQ | 2.0 | — |
| DTPMP | 0.4 | 0.4 |
| CMC | 0.4 | 0.4 |
| MA/AA | 4.0 | 2.0 |
| Agglomerates | | |
| LAS | 4.0 | 4.0 |
| TAS | 2.0 | 1.0 |
| Silicate | 3.0 | 4.0 |
| Zeolite A | 8.0 | 8.0 |
| Carbonate | 8.0 | 6.0 |
| Spray On | | |
| Perfume | 0.3 | 0.3 |
| C45E7 | 2.0 | 2.0 |
| C25E3 | 2.0 | — |
| Dry additives | | |
| Citric acid | 5.0 | 3.0 |
| Citrate | 5.0 | 2.0 |
| Bicarbonate | — | — |
| Carbonate | 8.0 | 10.0 |
| TAED | 6.0 | 5.0 |
| PB1 | 14.0 | 10.0 |
| Polyethylene oxide of MW 5,000,000 | — | 0.2 |
| Bentonite clay | — | 10.0 |
| Protease | 1.0 | 1.0 |
| Lipase | 0.4 | 0.4 |
| Amylase | 0.6 | 0.6 |
| Cellulase | 0.6 | 0.6 |
| Silicone antifoam | 5.0 | 5.0 |
| Dry additives | | |
| Sodium sulfate | 18.0 | 4.0 |
| Balance (Moisture and Miscellaneous) | 100.0 | 100.0 |

EXAMPLE 7

The following detergent formulations, according to the present invention were prepared:

| | S | T |
|---|---|---|
| Agglomerate | | |
| C45AS | 11.0 | 14.0 |
| CEQ | 3.0 | 3.5 |
| Zeolite A | 15.0 | 6.0 |
| Carbonate | 4.0 | 8.0 |
| MA/AA | 4.0 | 2.0 |
| CMC | 0.5 | 0.5 |
| DTPMP | 0.4 | 0.4 |
| Spray On | | |
| C25E5 | 5.0 | 5.0 |
| Perfume | 0.5 | 0.5 |
| Dry Adds | | |
| Citric acid | 1.5 | 2.0 |
| HBDP | 0.5 | 0.3 |
| SKS 6 | 13.0 | 10.0 |
| Citrate | 3.0 | 1.0 |
| TAED | 5.0 | 7.0 |
| Sodium Sulphate | 16.0 | 19.5 |

-continued

| | S | T |
|---|---|---|
| Percarbonate | 20.0 | 20.0 |
| SRP 1 | 0.3 | 0.3 |
| Protease | 1.4 | 1.4 |
| Lipase | 0.4 | 0.4 |
| Cellulase | 0.6 | 0.6 |
| Amylase | 0.6 | 0.6 |
| Silicone antifoam | 5.0 | 5.0 |
| Brightener 1 | 0.2 | 0.2 |
| Brightener 2 | 0.2 | — |
| Balance (Moisture and Miscellaneous) | 100 | 100 |

What is claimed is:

1. A granular detergent composition comprising at least 15% by weight of a sulphate salt, from about 1% to about 7% of an acid dispersing aid wherein at least 80% by weight of the acid dispersing aid has a particle size of from 150 $\mu$m to about 710 $\mu$m, and an alkali source having a particle size of from about 250 $\mu$m or greater, wherein said acid dispersing aid and alkali source are capable of reacting together in the presence of water to produce a gas, wherein the weight ratio of sulphate salt to said acid dispersing aid is from 13.5:1 or less, and wherein the acid dispersing aid is added as a separate granular component.

2. A detergent composition according to claim 1 wherein the alkali source comprises an alkaline salt selected from an alkali metal or alkaline earth metal carbonate, bicarbonate, sesqui-carbonate, or alkali metal percarbonate salt.

3. A detergent composition according to claim 1 wherein the acid dispersing aid comprises an organic, mineral or inorganic acid.

4. A detergent composition according to claim 3 wherein the acid dispersing aid is citric acid, glutaric acid, tartaric acid, succinic acid, adipic acid, monosodium phosphate, or boric acid or mixtures thereof.

5. A detergent composition according to claim 4 wherein the acid dispersing aid is citric acid.

6. A detergent composition according to claim 1 wherein the alkali source is present in an amount of from 5% to 60% by weight of the composition.

7. A detergent composition according to claim 1 wherein the sulphate salt is present at a level of at least 20.5% by weight, the acid dispersing aid is present from about 1% to about 10% by weight and the ratio of sulphate salt to acid dispersing aid is from 13.5:1 or less.

8. A detergent composition according to claim 1 wherein said sulphate is sodium sulphate or is a mixture of sodium sulphate and of from 0.2% to 5% by weight of magnesium sulphate.

9. A detergent composition according to claim 1, wherein the ratio of sulphate salt to acid dispersing aid is from 11:1 to 2:1.

10. A detergent composition according to claim 1, having a bulk density of less than 850 gr/liter.

11. A detergent composition according to claim 1 wherein the acid dispersing aid is capable of building or dispersing free ions present in the wash.

12. A method of washing laundry in a domestic washing machine comprising, introducing into a dispensing device which is placed in the drum of the washing machine, or introducing into the dispensing drawer of a washing machine, an effective amount of a detergent composition according to claim 1.

* * * * *